US007248820B2

(12) United States Patent
Iwasaki

(10) Patent No.: US 7,248,820 B2
(45) Date of Patent: Jul. 24, 2007

(54) COLOR IMAGE FORMING APPARATUS AND A METHOD FOR OPERATING

(75) Inventor: Takahiro Iwasaki, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 3 days.

(21) Appl. No.: 10/809,417

(22) Filed: Mar. 26, 2004

(65) Prior Publication Data

US 2004/0202496 A1 Oct. 14, 2004

(30) Foreign Application Priority Data

Apr. 14, 2003 (JP) ..... 2003-108746

(51) Int. Cl.
*G03G 15/00* (2006.01)

(52) U.S. Cl. ..... 399/167; 399/159; 399/339

(58) Field of Classification Search ..... 399/130, 399/154, 159, 167, 179, 184, 297–299, 308, 399/318, 302, 50, 53–55, 146, 227, 279, 399/328, 331, 339

See application file for complete search history.

(56) References Cited

U.S. PATENT DOCUMENTS 5,627,629 A * 5/1997 Takahashi et al. ..... 399/231
5,768,653 A * 6/1998 Fare ..... 399/50
5,794,110 A * 8/1998 Kasai et al. ..... 399/299
6,222,301 B1 * 4/2001 Sakai ..... 310/316.01
6,324,374 B1 * 11/2001 Sasamoto et al. ..... 399/298
6,384,511 B1 * 5/2002 Sakai ..... 310/316.01
6,420,807 B1 * 7/2002 Tsujimoto et al. ..... 310/83
6,442,356 B2 * 8/2002 Omata et al. ..... 399/66
6,522,861 B2 * 2/2003 Tokutake et al. ..... 399/401
6,556,802 B2 * 4/2003 Sasamoto et al. ..... 399/299
6,625,418 B2 * 9/2003 Kabai et al. ..... 399/329
6,633,733 B2 * 10/2003 Mochimaru et al. ..... 399/45
6,707,480 B2 * 3/2004 Ameyama et al. ..... 347/129
6,760,565 B2 * 7/2004 Watanabe et al. ..... 399/308
6,768,235 B2 * 7/2004 Tsujimoto et al. ..... 310/75 R
6,768,891 B2 * 7/2004 Sasamoto et al. ..... 399/228
6,799,010 B2 * 9/2004 Namiki ..... 399/298
6,839,532 B2 * 1/2005 Hoashi ..... 399/167

FOREIGN PATENT DOCUMENTS

JP 09-182488 7/1997

* cited by examiner

*Primary Examiner*—Brij Shrivastav
*Assistant Examiner*—Dixomara Vargas
(74) *Attorney, Agent, or Firm*—Finnegan, Henderson, Farabow, Garrett & Dunner, L.L.P.

(57) ABSTRACT

In order to provide a color image forming apparatus and its control method capable of obtaining high-quality output images without image variations or the like even when the kind of image is changed, there is provided a color image forming apparatus including a plurality of image carriers, a plurality of developing means corresponding to the image carriers, a plurality of transfer means that are fixed to the image carriers through an intermediate transfer body by the application of pressure, and a plurality of driving mechanisms for driving the image carriers to rotate, the color image forming apparatus comprising control means for selectively actuating the transfer means according to the kind of image and changing the control method for controlling the rotational speed of each driving mechanism according to the kind of image.

20 Claims, 3 Drawing Sheets

COLOR IMAGE FORMING APPARATUS AND A METHOD FOR OPERATING

BACKGROUND OF THE INVENTION

1. Field of the Invention

The present invention relates to an image forming apparatus such as a printer, a facsimile machine, and a copying machine, and its control method.

2. Description of Related Art

Color image forming apparatuses are conventionally known which perform feed-forward control of image carriers to control the variations in the rotational speed of each image carrier for each color so as to reduce color misregistration and variations (for example, see Japanese Patent Laid-Open No. 09-182488, paragraph Nos. 0022 and 0032, and FIG. 4).

Along with recent demand for high-quality color images without color misregistration and variation, there has also been increased demand for a single image forming apparatus capable of outputting various kinds of images such as monochrome images like documents, full-color images taken with a digital camera or the like, and unicolor images like POP (Point Of Purchase advertising) at a supermarket.

As is proposed in the above-mentioned patent document, a method of calculating correction information for feed-forward control of the rotation of a rotating body such as an image carrier at power-on so that the rotation of the rotating body will be controlled based on the correction information calculated becomes suitable for certain kinds of images because the method reduces rotational variations with respect to the conditions calculated.

However, in the case of color image forming apparatuses, for example of tandem type that combines and outputs different kinds of images such as color images and monochrome images, since the number of toner colors varies with the kind of image, the number of fixing means or the like (load) that directly act on each corresponding image carrier needs to be changed each time an image or combined image is transferred from the image carrier to an intermediate transfer body. Therefore, if it is required to output an image under conditions other than those for which the correction information has been calculated, the above-mentioned type of color image forming apparatuses cannot reduce rotational variations, resulting in a reduction in image quality.

SUMMARY OF THE INVENTION

The present invention has been made in view of the above-mentioned conventional drawbacks, and it is an object thereof to provide an image forming apparatus and its control method capable of obtaining highquality output images with reduced image variations even when the kind of image is changed.

The inventors has studied and found an additional problem that since, for example, the number of image carriers to be-actuated and the number of transfer rollers to be pressed on corresponding image carriers vary depending on the kind of image to be formed, such as monochrome or color, the mechanical resonance frequency of a driving system of each image carrier including a transfer roller could vary.

The inventor has also focused attention on the fact that, when feed-forward control of the rotation of each image carrier or the like is performed, it is difficult to sufficiently control the rotation of the driving system of each image carrier having a different resonance frequency according to correction information based on a predetermined resonance frequency. From this fact, the inventor has thought that stable speed control can be performed by performing driving control such as control of the speed of the image carrier or the like based on correction information corresponding to each kind of image, and reached the idea of the present invention. It is preferable that the correction information corresponding to various kinds of images be prestored in storage means so that correction information corresponding to the kind of image inputted by an operator at the time of image formation will be read from the storage means to perform driving control of each image carrier or the like based on the read-out correction information.

In order to attain the above object, the following preferred aspects are proposed.

(1) According to the first aspect of the invention, an image forming apparatus comprises: a plurality of image carriers; a plurality of transfer means, each of which is provided corresponding to each of the plurality of image carriers and fixed to each of the plurality of image carriers through an intermediate transfer body or recording material by the application of pressure; a plurality of driving means for driving the plurality of image carriers to rotate; and control means for controlling the driving means, wherein the control means changes the control method for the driving means according to the kind of image so that the transfer means will be selectively operated according to the kind of image.

(2) The image forming apparatus according to the first aspect further comprises an intermediate transfer body, wherein the plurality of transfer means are fixed to the plurality of image carriers through the intermediate transfer body by the application of pressure.

(3) In the image forming apparatus according to the first aspect, the control means controls the driving means to drive the image carriers according to correction information based on a mechanical resonance frequency of the driving systems of the image carriers corresponding to the kind of image.

(4) In the image forming apparatus according to item (3), the correction information is correction information for feed-forward control, and the control means controls the driving means to perform feed-forward control of the image carriers based on the correction information.

(5) The image forming apparatus according to the first aspect further comprises storage means for storing plural pieces of correction information in association with kinds of images, wherein the control means reads the correction information from the storage means according to the kind of image, and controls the driving means to drive the image carriers based on the correction information.

(6) According to the second aspect of the invention, an image forming apparatus comprises: a plurality of image carriers; an intermediate transfer body; a plurality of transfer means for transferring toner images formed on the plurality of image carriers onto the intermediate transfer body, each of the plurality of transfer means provided corresponding to each of the plurality of image carriers and fixed to each of the plurality of image carriers through the intermediate transfer body by the application of pressure; driving means for driving the intermediate transfer body; and control means for controlling the driving means, wherein the control means changes the control method for the driving means according to the kind of image so that the transfer means will be selectively operated according to the kind of image.

(7) The image forming apparatus according to item (6) further comprises an intermediate transfer body, wherein the plurality of transfer means are fixed to the plurality of image carriers through the intermediate transfer body by the application of pressure.

(8) In the image forming apparatus according to item (6), the control means controls the driving means to drive the image carriers according to correction information based on a mechanical resonance frequency of the driving systems of the image carriers corresponding to the kind of image.

(9) In the image forming apparatus according to item (8), the correction information is correction information for feed-forward control, and the control means controls the driving means to perform feed-forward control of the image carriers based on the correction information.

(10) The image forming apparatus according to item (6) further comprises storage means for storing plural pieces of correction information in association with kinds of images, wherein the control means reads the correction information from the storage means according to the kind of image, and controls the driving means to drive the image carriers based on the correction information.

(11) According to the third aspect of the invention, a control method for a color image forming apparatus comprises the steps of: selectively actuating transfer means according to the kind of image; reading correction information related to control of the rotational speed of each image carrier from storage means according to the kind of image; controlling the rotational speed of the image carrier based on the read-out correction information; and transferring a toner image of a specific color on the image carrier onto an intermediate transfer body at a controlled rotational speed.

(12) In the control method for a color image forming apparatus according to item (11), the correction information related to control of the rotational speed is correction information for feed-forward control of each image carrier performed by the driving mechanism, the correction information including a frequency component based on a mechanical resonance frequency of the driving system of the image carrier.

(13) According to the fourth aspect of the invention, a color image forming apparatus includes a plurality of image carriers, a plurality of developing means corresponding to the plurality of image carriers, a plurality of transfer means that are fixed to the image carriers through an intermediate transfer body by the application of pressure, and a plurality of driving mechanisms for driving the image carriers to rotate, the color image forming apparatus comprising control means for selectively actuating the transfer means according to the kind of image and changing the control method for controlling the rotational speed of each driving mechanism according to the kind of image.

(14) The color image forming apparatus according to item (13), the control means can change correction information for feed-forward control based on a mechanical resonance frequency of the driving system of each image carrier so that each corresponding driving mechanism will drive the image carrier based on the changed correction information.

(15) According to the fifth aspect of the invention, a control method for a color image forming apparatus comprises the steps of: selectively actuating transfer means according to the kind of image; reading correction information related to control of the rotational speed of each image carrier from storage means according to the kind of image; controlling the rotational speed of the image carrier based on the read-out correction information; and transferring a toner image of a specific color on the image carrier onto an intermediate transfer body at a controlled rotational speed.

(16) In the control method for a color image forming apparatus according to item (15), the correction information related to control of the rotational speed is correction information for feed-forward control of each image carrier performed by the driving mechanism, the correction information including a frequency component based on a mechanical resonance frequency of the driving system of the image carrier.

DETAILED DESCRIPTION OF THE PREFERRED EMBODIMENT

The invention will now be described with reference to its preferred embodiment. The following description is not intended to limit the technical scope of the appended claims, and the meaning of technical terms and the description of the embodiment are just to illustrate a preferred example, not to limit the technical scope of the present invention and the meaning of technical terms used in the description of the present invention.

Although in a color image forming apparatus, an image forming body is denoted as either a drum-shaped photosensitive body or a belt-shaped intermediate transfer body, a color image forming apparatus using a belt-shaped intermediate transfer body as an image forming body is taken by way of example to describe the present invention.

Figure 1:
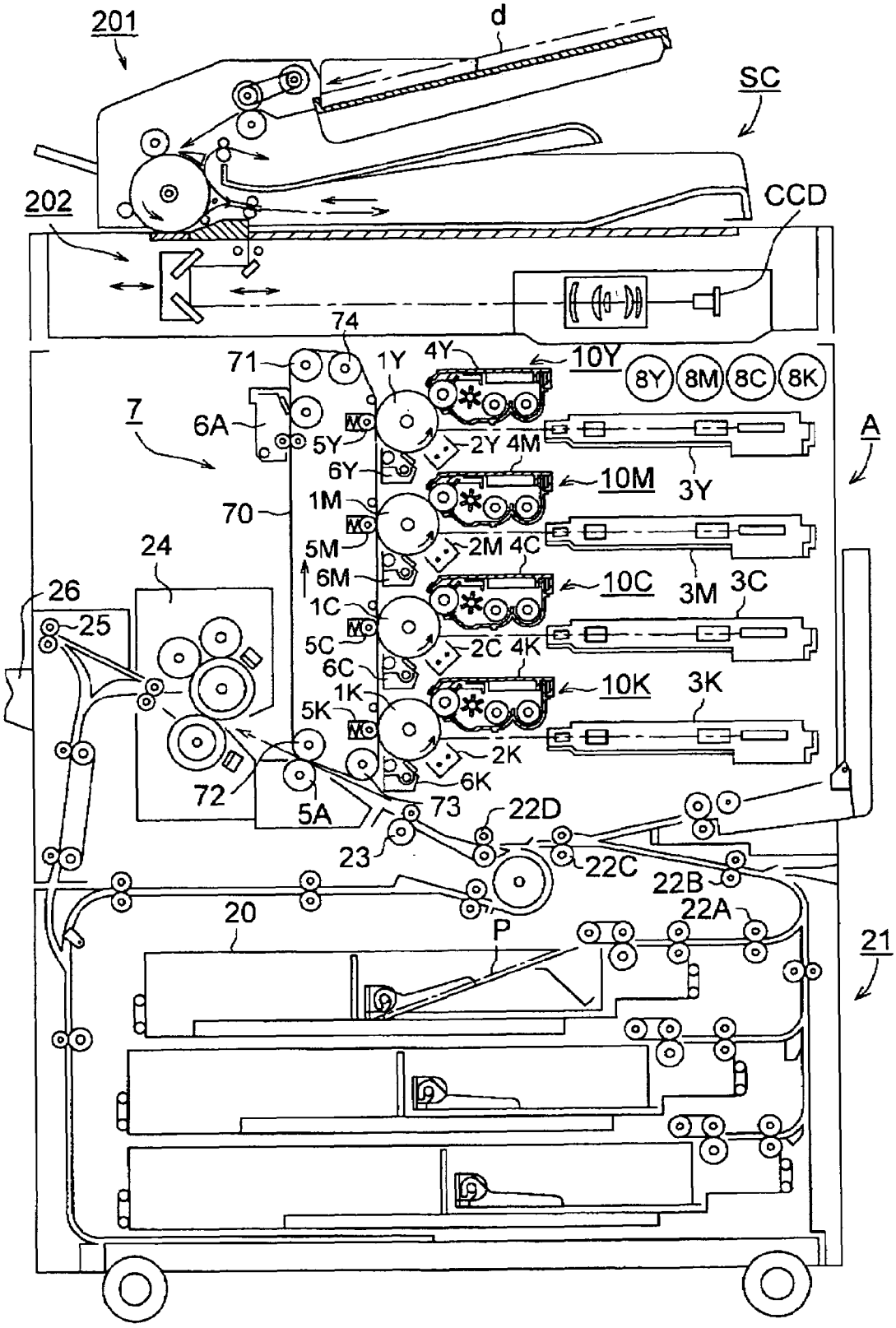
FIG. 1 is a sectional view showing the structure of one preferred embodiment of a color image forming apparatus according to the present invention.

FIG. 1 is a sectional view showing the structure of one preferred embodiment of a color image forming apparatus according to the present invention.

This color image forming apparatus is a so-called tandem-type full-color copying machine and includes a plural set of image forming sections 10Y, 10M, 10C, and 10K, an intermediate transfer body unit 7, paper feeding means 21, and fixing means 24.

Arranged on a body A of the image forming apparatus is an original image scanning device SC made up of an automatic document feeder 201 and an original image scanning/exposing device 202, in which a document d fed from the automatic document feeder 201 is scanned by a line image sensor CCD as an optical system of the original image scanning/exposing device 202.

An analog signal that has been subjected to photoelectric conversion by means of the line image sensor CCD is subjected to various kinds of processing in an image processing section, not shown, such as analog processing, A/D conversion, shading correction, image compression, etc., and sent to exposure means 3Y, 3M, 3C, and 3K as digital image data for each color so that a latent image corresponding to each image data will be formed on a drum-shaped photosensitive body (hereinafter also called a "photosensitive body") as each corresponding first image carrier.

The image forming sections 10Y, 10M, 10C, and 10K are arranged vertically in tandem, and on the left side of the photosensitive bodies 1Y, 1M, 1C, and 1K in the figure, an intermediate transfer body 70 as a semiconductive endless belt-shape second image carrier wound around rollers 71, 72, 73, and 74 is arranged so that it will be rotatably stretched.

The intermediate body 70 is fed in the direction of the arrow by a driving mechanism, not shown, through the roller 71. As will be described later, the driving mechanism is connected to the roller 71.

The image forming section 10Y for forming yellow images includes charging means 2Y, exposure means 3Y, developing means 4Y, a primary transfer roller 5Y as primary transfer means, and cleaning means 6Y, all of which are arranged around the photosensitive body 1Y.

The image forming section 10M for forming magenta images includes the photosensitive body 1M, charging means 2M, exposure means 3M, developing means 4M, a primary transfer roller 5M as primary transfer means, and cleaning means 6M.

The image forming section 10C for forming cyan images includes the photosensitive body 1C, charging means 2C, exposure means 3C, developing means 4C, a primary transfer roller 5C as primary transfer means, and cleaning means 6C.

The image forming section 10K for forming black images includes the photosensitive body 1K, charging means 2K, exposure means 3K, developing means 4K, a primary transfer roller 5K as primary transfer means, and cleaning means 6K.

Toner replenishing means 8Y, 8M, 8C, and 8K replenish the developing devices 4Y, 4M, 4C, and 4K with fresh toner, respectively.

The primary transfer rollers 5Y, 5M, 5C, and 5K are controlled by control means, not shown, to be selectively operated according to the kind of image to press the intermediate transfer body 70 on each corresponding photosensitive body 1Y, 1M, 1C, or 1K.

The image forming sections 10Y, 10M, 10C, and 10K form images for respective colors on the photosensitive bodies 1Y, 1M, 1C, and 1K, respectively, and the primary transfer rollers 5Y, 5M, 5C, and 5K transfer the images for respective colors onto the rotating intermediate body 70 one after another to form a combined, color image.

On the other hand, paper P as a recording medium set in a paper feed cassette 20 is fed by paper feed means 21 to a secondary transfer roller 5A as secondary transfer means through plural intermediate rollers 22A, 22B, 22C, 22D and a resist roller 23 so that the secondary transfer roller 5A will transfer the combined image from the intermediate transfer body 70 onto-paper P by one operation.

The secondary transfer roller 5A comes in pressure contact with the roller 72 through the intermediate transfer body 70 only when paper P is passed through for secondary transfer.

Paper P on which the color image is transferred is fixed by the fixing means 24, and dropped onto an external output tray 26 while being supported by a pair of delivery rollers 25 in a sandwiched manner.

On the other hand, the intermediate transfer body 70 from which paper P is separated by the curvature of the edge of the intermediate transfer body 70 after the color image has been transferred on paper P by means of the secondary transfer roller 5A is cleaned by cleaning means 6A so that residual toner will be removed.

In the following description, feed-forward control in the narrow sense indicates that only feed-forward control is performed without feedback control, and feedback control in the narrow sense indicates that only feedback control is performed without feed-forward control. Further, in the case that feed-forward control is simply mentioned, it means that both the feed-forward control in the narrow sense and the feedback control in the narrow sense are performed.

The feed-forward control in the narrow sense is performed based on predetermined correction information.

Figure 2:
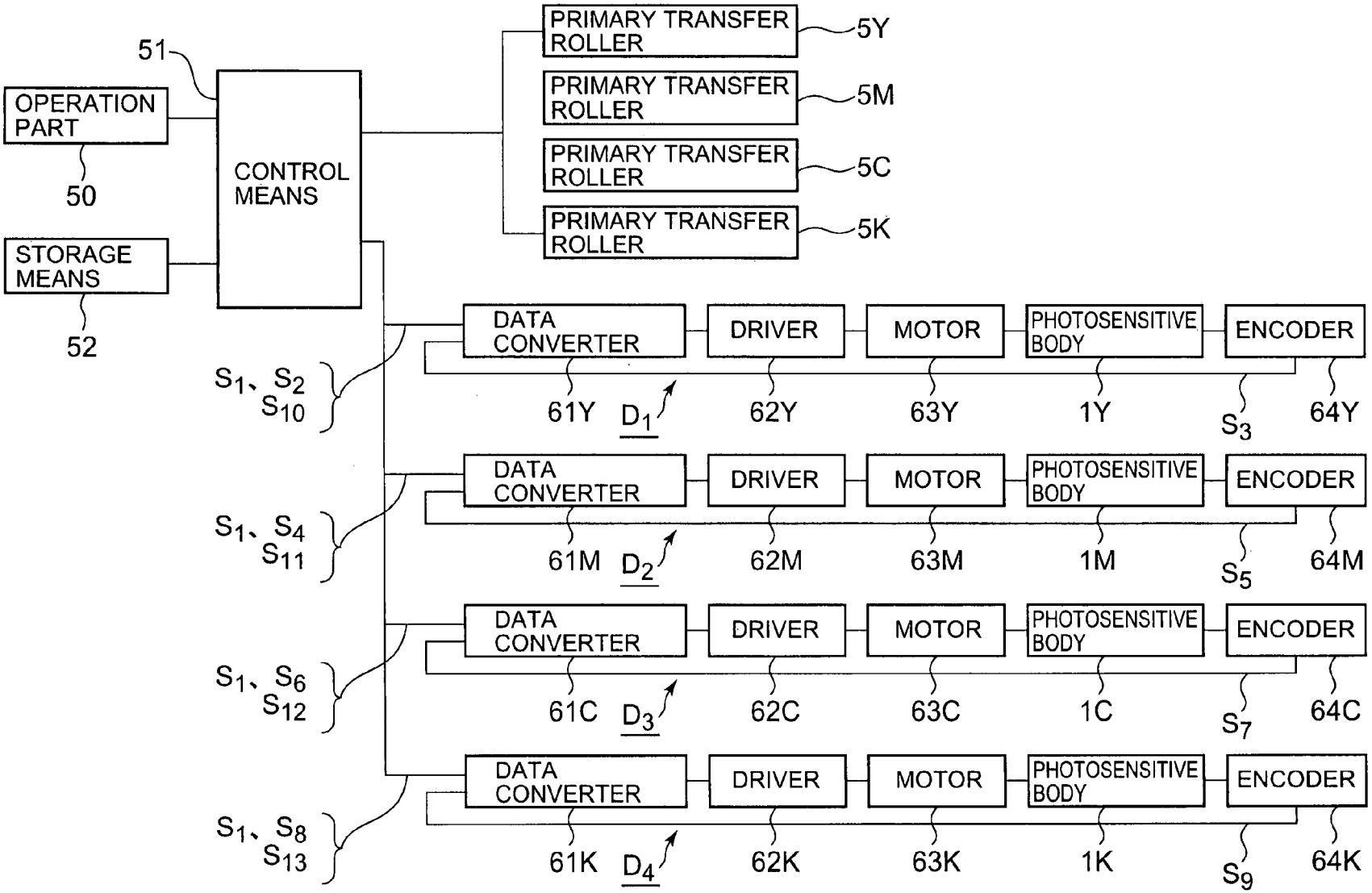
FIG. 2 is a block diagram showing the flow of control of the preferred embodiment of the color image forming apparatus according to the present invention.

FIG. 2 is a block diagram showing the flow of control of the embodiment of the color image forming apparatus according to the present invention.

Referring to FIGS. 1 and 2, an overview of how to control the color image forming apparatus according to the present invention will be described below.

An operation-part 50 such as a touch panel is provided on the body A; it is used to input to control means 51 the kind of image such as monochrome, full color, or unicolor (Y (yellow), M (magenta), C (cyan)).

Stored in storage means 52 are correction information for feed-forward control of each photosensitive body corresponding to the kind of image, target speed information related to the target speed of each photosensitive body, correction information for feed-forward control of the intermediate transfer body according to the kind of image, and target speed information related to the intermediate transfer body. The storage means 52 is connected to the control means 51 so that the correction information for feed-forward control of each photosensitive body, the correction information for feed-forward control of the intermediate transfer body, the target speed information on each photosensitive body, and the target speed information on the intermediate transfer body will be inputted to the control means 51 on demand from the control means. The primary transfer rollers 5Y, 5M, 5C, and 5K are connected to the control means 51, and selectively operated under the control of the control means 51 so that a selected primary transfer roller will be fixed to each corresponding photosensitive body (1Y-1K) by the application of pressure or released from the photosensitive body.

A driving mechanism $D_1$ for the photosensitive body 1Y is such that the output of a data converter 61Y is connected to a motor driver 62Y, and the output of the driver 62Y is connected to a motor 63Y for driving the photosensitive body 1Y so that the motor 63Y will drive the photosensitive body 1Y through a speed reducer, not shown, to rotate in the direction of the arrow.

Then, an encoder 64Y is connected to the photosensitive body 1Y to detect the rotational speed of the photosensitive body 1Y, so that speed information $S_3$ on the photosensitive body 1Y is inputted to the data converter 61Y.

Target speed information $S_1$ on the photosensitive body 1Y and correction information $S_2$ for feed-forward control are also inputted to the data converter 61 from the control means 51, so that not only feed-forward control in the narrow sense is performed based on speed information (converted data) obtained by calculating the sum of the target speed information $S_1$ and the correction information $S_2$, but also feedback control in the narrow sense is performed based on the speed information $S_3$.

A driving mechanism $D_2$ for the photosensitive body 1M is such that the output of a data converter 61M is connected to a motor driver 62M, and the output of the driver 62M is connected to a motor 63M for driving the photosensitive body 1M so that the motor 63M will drive the photosensitive body 1M through a speed reducer, not shown, to rotate in the direction of the arrow based on the target speed information $S_1$, correction information $S_4$ for feed-forward control, and speed information $S_5$ from an encoder 64M in the same manner as the photosensitive body 1Y is controlled.

A driving mechanism $D_3$ for the photosensitive body 1C is such that the output of a data converter 61C is connected to a motor driver 62C, and the output of the driver 62C is connected to a motor 63C for driving the photosensitive body 1C so that the motor 63C will drive the photosensitive body 1C through a speed reducer, not shown, to rotate in the direction of the arrow based on the target speed information $S_1$, correction information $S_6$ for feed-forward control, and speed information $S_7$ from an encoder 64C in the same manner as the photosensitive body 1Y is controlled.

A driving mechanism $D_4$ for the photosensitive body 1K is such that the output of a data converter 61K is connected to a motor driver 62K, and the output of the driver 62K is connected to a motor 63K for driving the photosensitive body 1K so that the motor 63K will drive the photosensitive body 1K through a speed reducer, not shown, to rotate in the direction of the arrow based on the target speed information $S_1$, correction information $S_8$ for feed-forward control, and speed information $S_9$ from an encoder 64K in the same manner as the photosensitive body 1Y is controlled.

The intermediate transfer body 70 is also subjected to feed-forward control based on the same ideas as those of controlling the photosensitive bodies. For this end, correction information for feed-forward control of the transfer means is prestored in the storage means 52 in association with each kind of image. Then, feed forward control may be performed such that control means 51 reads from the storage means 52 correction information for feed-forward control of the transfer means according to the kind of image, and outputs target speed information and the correction information for feed-forward control to a driving mechanism, so that the rotational speed of the roller 71 is detected by an encoder and controlled by the driving mechanism based on the target speed information and the correction information for feed-forward control.

The phrase "changes the control method" described in the appended claims denotes a change from the above-mentioned feed-forward control to the feedback control in the narrow sense alone, and vice versa, or a change in the correction information for feed-forward control or the correction information for feed-forward control of the transfer means ($S_2$, $S_4$, $S_6$, $S_8$, $S_{10}$, $S_{11}$, $S_{12}$, $S_{13}$) inputted to each data converter.

Figure 3:
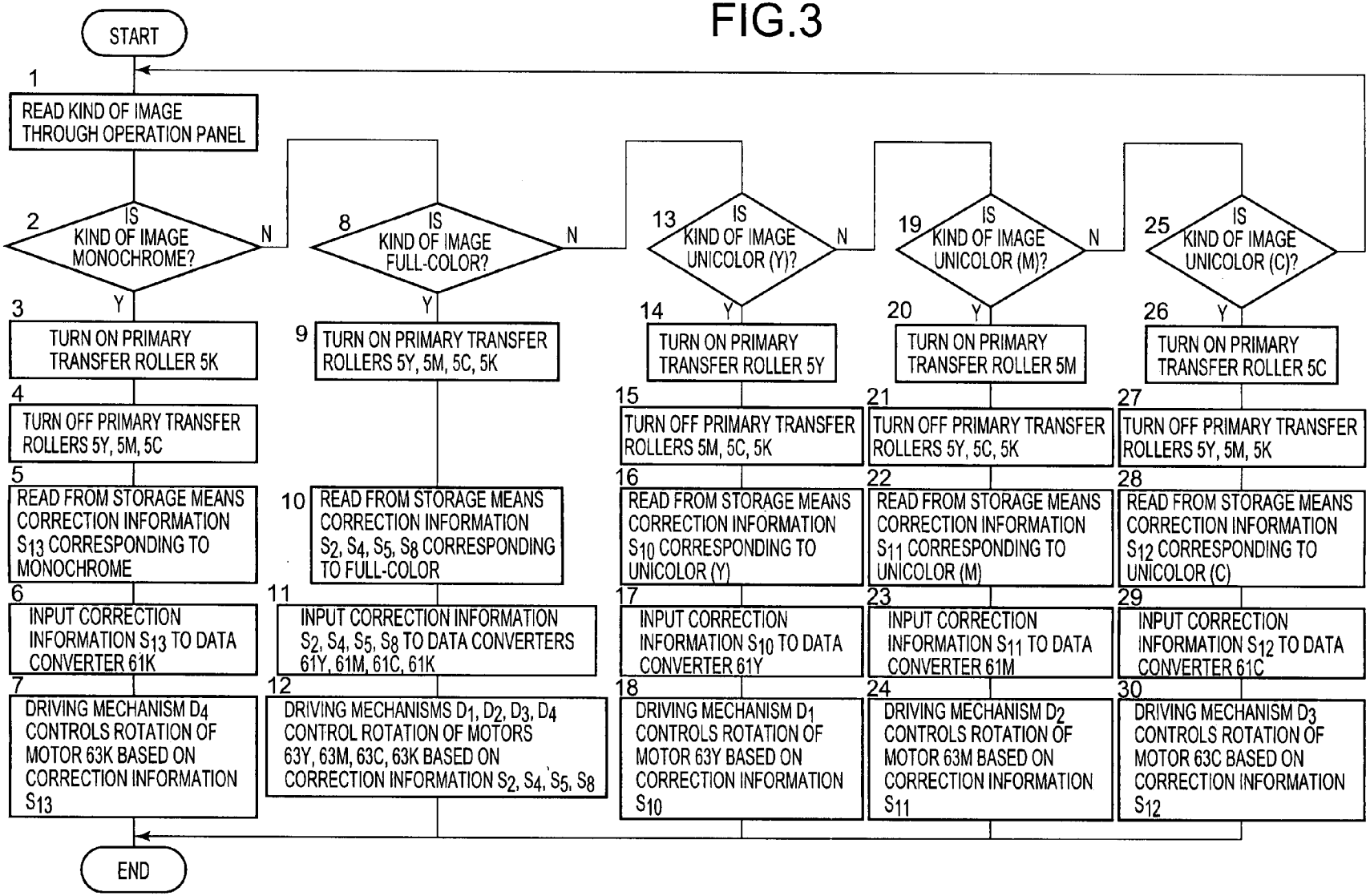
FIG. 3 is a flowchart showing the operation of the preferred embodiment of the color image forming apparatus according to the present invention.

FIG. 3 is a flowchart showing how to control the preferred embodiment of the color image forming apparatus according to the present invention.

Referring to FIGS. 1 to 3, a control method for the color image forming apparatus will be described below by taking the following three cases as examples: in the case of forming a monochrome image, in the case of forming a full-color image, and in the case of forming a yellow image as a representative of unicolor images.

At first, a description will be made about the case of a monochrome image.

Step 1: The control means 51 reads the kind of image (monochrome/full-color/unicolor (Y, M, C)) inputted on the operation panel such as a touch panel, and proceeds to step 2.

Step 2: The control means 51 determines whether the read-out kind of image is monochrome, and if yes, it proceeds to step 3, or if no, it jumps to step 8.

Step 3: When determining that the kind of image is monochrome, the control means 51 turns on the primary transfer roller 5K to force the primary transfer roller 5K into pressure contact with the photosensitive body 1K though the intermediate transfer body 70, thus making primary transfer of a black image available.

Step 4: The control means 51 turns off the primary transfer rollers 5Y, 5M, and 5C, and proceeds to step 5. Turning off the primary transfer rollers 5Y, 5M, and 5C make them separate from the photosensitive bodies 1Y, 1M, and 1C, respectively, to make their primary transfer mechanisms disabled, thereby preventing the intermediate transfer body and the photosensitive bodies from getting damaged or worn down.

Step 5: The control means 51 reads feed-forward correction information $S_{13}$ prestored in the storage means 52 and the target speed information $S_1$ on the photosensitive body 1K corresponding to the read-out kind of image (monochrome), and proceeds to step 6.

The feed-forward correction information $S_{13}$ is correction information based on a resonance frequency (having a frequency component corresponding to a mechanical resonance frequency) for the driving system of the photosensitive body in such conditions that only the transfer roller 5K is in pressure contact with the photosensitive body through the intermediate transfer body, and the other transfer rollers 5Y, 5M, and 5C are not in pressure contract with the respective photosensitive bodies through the intermediate transfer body.

Step 6: The control means 51 inputs the feed-forward correction information $S_{13}$ and the target speed information $S_1$ on the photosensitive body 1K to the data converter 61K in the driving mechanism $D_4$ for driving the photosensitive body 1K, and proceeds to step 7.

Step 7: The data converter 61K actuates the motor 63K through the driver 62K (feed-forward control in the narrow sense) based on speed information (converted data) obtained by calculating the sum of the target speed information $S_1$ and the feed-forward correction information $S_{13}$. Then, speed information $S_9$ from the encoder 64K that is directly connected to the photosensitive body 1K to detect the rotational speed of the photosensitive body 1K is inputted to the data converter 61 to perform feedback control in the narrow sense.

By concurrently performing the feed-forward control in the narrow sense and the feedback control in the narrow sense as mentioned above, feed-forward control is performed to form and transfer a monochrome image, and after completion, the procedure proceeds to end step.

After completion of transfer of the monochrome image onto the intermediate transfer body, the primary transfer roller 5K is turned off.

When the kind of image is monochrome, since only a black image is formed, two or more photosensitive bodies do not need actuating. Therefore, only the photosensitive body 1K and the primary transfer roller 5K are actuated to prevent mutual interference between photosensitive bodies. Since no problem with even slight misregistration of colors arises, only the feed-forward control in the narrow sense based on the target speed information $S_1$ and the speed information $S_9$ may be performed instead of the above-mentioned feed-forward control. In this case, the control means does not need to input the feed-forward correction information.

Further, when "monochrome" is inputted as the kind of image through the operation means, the control means may automatically switch the control method from the feed-forward control to the feedback control in the narrow sense.

The following describes the case of a full-color image.

Step 8: The control means 51 determines whether the read-out kind of image is full-color, and if yes, it proceeds to step 9, or if no, it jumps to step 13.

Step 9: When determining that the kind of image is full-color, the control means 51 turns on the primary transfer rollers 5Y, 5M, 5C, and 5K to force the primary transfer rollers 5Y, 5M, 5C, and 5K into pressure contact with the photosensitive bodies 1Y, 1M, 1C, and 1K, respectively, though the intermediate transfer body 70, thus making primary transfer of a full-color image available.

In the following description, all the reference numbers may not be mentioned. For example, the data converters 61Y, 61M, 61C, and 61K may be expressed as the data converters 61Y-61K for convenience sake.

Step 10: The control means 51 reads the feed-forward correction information $S_2$ on the photosensitive body 1Y, the feed-forward correction information $S_4$ on the photosensitive body 1M, the feed-forward correction information $S_6$ on the photosensitive body 1C, and the feed-forward correction information $S_8$ on the photosensitive body 1K prestored in the storage means 52, and the target speed information $S_1$ on the photosensitive bodies 1Y-1K, all of which correspond to the read-out kind of image (full-color), and proceeds to step 11.

Each of the feed-forward correction information $S_2$, $S_4$, $S_6$, and $S_8$ is correction information based on a resonance frequency (having a frequency component corresponding to a mechanical resonance frequency) for the driving system of each photosensitive body in such a condition that all the primary transfer rollers are in pressure contact with the respective photosensitive bodies through the intermediate transfer body.

Step 11: The control means 51 inputs the feed-forward correction information $S_2$ and the target speed information $S_1$ on the photosensitive body 1Y to the data converter 61Y, the feed-forward correction information $S_4$ and the target speed information $S_1$ on the photosensitive body 1M to the data converter 61M, the feed-forward correction information $S_6$ and the target speed information $S_1$ on the photosensitive body 1C to the data converter 61C, and the feed-forward correction information $S_8$ and the target speed information $S_1$ on the photosensitive body 1K to the data converter 61K, and proceeds to step 12.

Step 12: The data converters 61Y-61K actuates the motors 63Y-63K through the drivers 62Y-62K based on speed information (converted data) obtained by calculating the sums of the target speed information S1 and the feed-forward correction information $S_2$, $S_4$, $S_6$, and $S_8$ (feed-forward control in the narrow sense). Then, all pieces of speed information $S_3$, $S_5$, $S_7$, and $S_9$ from the encoders 64Y-64K that are directly connected to the photosensitive bodies 1Y-1K to detect the rotational speed of each corresponding photosensitive body are inputted to the respective data converters 61Y-61K to perform feedback control in the narrow sense.

By concurrently performing the feed-forward control in the narrow sense and the feedback control in the narrow sense as mentioned above, feed-forward control is performed to form and transfer a full-color image, and after completion, the procedure proceeds to end step.

The following describes the case of a unicolor image (Y).

Step 13: The control means determines whether the read-out kind of image is unicolor (Y), and if yes, it proceeds to step 14, or if no, it jumps to step 19.

Step 14: When determining that the kind of image is unicolor (Y), the control means 51 turns on the primary transfer roller 5Y to force the primary transfer roller 5Y into pressure contact with the photosensitive body 1Y, thus making primary transfer of a unicolor image (Y) available.

Step 15: The control means 51 turns off the primary transfer rollers 5M, 5C, and 5K, and proceeds to step 16. Turning off the primary transfer rollers 5M, 5C, and 5K make them separate from the photosensitive bodies 1M, 1C, and 1K, respectively, to make their primary transfer mechanisms disabled, thereby preventing the intermediate transfer body and the photosensitive bodies from getting damaged or worn down.

Step 16: The control means 51 reads feed-forward correction information $S_{10}$ prestored in the storage means 52 and the target speed information $S_1$ on the photosensitive body 1Y corresponding to the read-out kind of image (unicolor (Y)), and proceeds to step 17.

The feed-forward correction information $S_{10}$ is correction information based on a resonance frequency (having a frequency component corresponding to a mechanical resonance frequency) for the driving system of each photosensitive body including the intermediate transfer body in such a condition that only the transfer roller 5Y is in pressure contact with the photosensitive body.

Step 17: The control means 51 inputs the feed-forward correction information $S_{10}$ and the target speed information $S_1$ on the photosensitive body 1Y to the data converter 61Y in the driving mechanism $D_1$ for driving the photosensitive body 1Y, and proceeds to step 18.

Step 18: The data converter 61Y actuates the motor 63Y through the driver 62Y (feed-forward control in the narrow sense) based on speed information (converted data) obtained by calculating the sum of the target speed information $S_1$ and the feed-forward correction information $S_{10}$. Then, speed information $S_3$ from the encoder 64Y that is directly connected to the photosensitive body 1Y to detect the rotational speed of the photosensitive body 1Y is inputted to the data converter 61Y to perform feedback control in the narrow sense.

By concurrently performing the feed-forward control in the narrow sense and the feedback control in the narrow sense as mentioned above, feed-forward control is performed to form and transfer a yellow image, and after completion, the procedure proceeds to end step.

Steps 19 to 24 show the flow of forming and transferring a magenta image by means of the driving mechanism $D_2$ based on the same ideas as those in the above-mentioned method of forming and transferring the yellow image, and steps 25 to 30 show the flow of forming and transferring a cyan image by means of the driving mechanism $D_3$ based on the same ideas as those in the above-mentioned method of forming and transferring the yellow image. Therefore, the description of these steps will be omitted.

Note here that the control means 51 determines at step 25 whether the read-out kind of image is unicolor (C). If not unicolor (C), the procedure returns to step 1 to confirm the read image. In the case that the kind of image is unicolor (Y), (M), or (C), that is, when only one transfer roller comes in pressure contact with the corresponding photosensitive body through the intermediate transfer body to form an image, since no problem with even slight misregistration of colors arises, like in the case of the monochrome image, only the feed-forward control in the narrow sense based on the target speed information and the speed information may be performed instead of the above-mentioned feed-forward control. In this case, the control means does not need to input the feed-forward correction information.

Although the above mainly describes the transfer means for transfer from each photosensitive body to the belt-shaped intermediate transfer body, the intermediate transfer body may have a drum shape.

Further, a unicolor image is described above as one kind of image, it may be an image with two or more colors. In this case, corresponding two or more primary transfer rollers are operated based on the same idea to read two or more pieces of correction information so as to perform feed-forward control based on the correction information. The feed-forward correction information is created based on a resonance frequency for the driving systems of each photosensitive body in such a condition that only the two or more primary transfer rollers are operated to come in pressure contact with corresponding photosensitive bodies through the intermediate transfer body.

In addition to the feed-forward control of the photosensitive bodies, feed-forward control of the driving roller 72 for driving the intermediate transfer body may be performed. In this case, the feed forward correction information may be changed with a change in resonance frequency for the driving system of the intermediate transfer body by turning on/off the transfer rollers according to the kind of image. The correction information for feed-forward control is predetermined for each kind of image, and stored in the storage means 52, so that the control means reads the correction information for feed-forward control according to the kind o image to perform feed-forward control of rotation of the driving roller 72 for the intermediate transfer body based on the feed-forward correction information that matches the kind of image, thereby reducing the rotational variations of the intermediate transfer body.

In the above description, the control means outputs feed-forward correction information corresponding to the kind of image to the data converter of each driving mechanism according to the kind of image from the operation part, but the control means may output information on the kind of image to the data converter of each driving mechanism so that the data converter will read feed-forward correction information from the storage means connected to the data converter according to the kind of image, thereby performing feed-forward control.

Further, communication means for communication with the outside world may be provided for receiving the kind of image for which a primary transfer roller(s) is selected and correction information is read out of the storage means.

In the embodiment, correction information for feed-forward control is prestored in the storage means for each kind of image so that feed forward control will be performed by reading the correction information from the storage means, but the correction information for feed-forward control may be determined each time a kind of image is inputted through the operation part. According to the embodiment, since feed-forward correction information is prestored for each kind of image so that feed forward control will be performed according to the kind of image, it has the effect of providing a color image forming apparatus and its control method capable of obtaining high-productivity, high-quality output images with no or few image variations or the like without the need to calculate the correction information for rotation control at power-on and recalculate the correction information even when the kind of image is changed.

According to the present invention, since driving control of the image carriers and/or the driving means of the intermediate transfer body is changed according to the kind of image, correction corresponding to a resonance frequency of the driving system can be performed according to the kind of image, so that rotational variations can be reduced, thereby obtaining high-productivity, high-quality output images with low image variations. Further, in the case of color images, high-quality output images with reduced color misregistration can be obtained.

What is claimed is:

1. An image forming apparatus comprising:

a plurality of image carriers;

a plurality of transfer units, each of which is provided corresponding to each of said plurality of image carriers, each of said plurality of transfer units being contacted under pressure with each of said plurality of image carriers through an intermediate transfer body or recording material by the application of pressure when each of said plurality of transfer units is operating and not contacting each of said plurality of image carriers when each of said plurality of transfer units is not operating;

a plurality of driving units for driving said plurality of image carriers to rotate at a rotary speed; and a control unit for controlling said plurality of driving units to drive said plurality of image carriers under a feed-forward control and a feed-back control, the control unit controlling said plurality of driving units according to correction information, wherein the correction information used for the feed-forward control is different depending upon a kind of image, wherein said control unit makes said plurality of transfer units to be selectively operated according to the kind of image and said control unit changes a speed control method for said plurality of driving units according to the kind of image, wherein the kind of image includes a full-color image, a mono-chrome image, or a uni-color image.

2. The image forming apparatus according to claim 1, further comprising:

an intermediate transfer body, wherein said plurality of transfer units are fixed to said plurality of image carriers through said intermediate transfer body by the application of pressure.

3. The image forming apparatus according to claim 1, wherein said control unit controls said plurality of driving units to drive said plurality of image carriers according to correction information based on a mechanical resonance frequency of the driving systems of said plurality of image carriers corresponding to the kind of image.

4. The image forming apparatus according to claim 3, wherein the correction information is correction information for feed-forward control, and said control unit controls said plurality of driving units to perform feed-forward control of said plurality of image carriers based on the correction information.

5. The image forming apparatus according to claim 1, further comprising:

storage means for storing plural pieces of correction information in association with kinds of images, wherein said control unit reads the correction information from said storage unit according to the kind of image, and controls said plurality of driving units to drive said plurality of image carriers based on the correction information.

6. The image forming apparatus according to claim 5, comprising a input unit to set the kind of image.

7. The image forming apparatus according to claim 5, wherein said control unit controls said driving unit to drive said image carriers by using correction information based on the kind of image.

8. The image forming apparatus according to claim 7, wherein a feed-forward control is carried out by said control unit with the correction information based on the kind of image.

9. The image forming apparatus according to claim 1, comprising an input unit to set the kind of image.

10. The image forming apparatus according to claim 1, wherein said control unit controls said driving unit to drive said image carriers by using correction information based on the kind of image.

11. The image forming apparatus according to claim 10, wherein a feed-forward control is carried out by said control unit with the correction information based on the kind of image.

12. The image forming apparatus according to claim 1, wherein the rotary speed of the plurality of image carriers is the same for any kind of image.

13. An image forming apparatus comprising:

a plurality of image carriers;

an intermediate transfer body;

a plurality of transfer units for transferring toner images formed on said plurality of image carriers onto said intermediate transfer body, each of which is provided corresponding to each of said plurality of image carriers, each of said plurality of transfer units being contacted under pressure with each of said plurality of image carriers through said intermediate transfer body by the application of pressure when each of said plurality of transfer units is operating and not contacting each of said plurality of image carriers when each of said plurality of transfer units is not operating;

a driving unit for driving said intermediate transfer body to rotate at a rotary speed; and a control unit for controlling said driving unit to drive said intermediate transfer body under a feed-forward control and a feed-back control, the control unit controlling said driving unit according to correction information, wherein correction information used for the feed-forward control is different depending upon a kind of image, wherein said control unit makes said plurality of transfer units to be selectively operated according to the kind of image and said control unit changes a speed control method for said driving unit according to the kind of image, wherein the kind of image includes a full-color image, a mono-chrome image, or a uni-color image.

14. The image forming apparatus according to claim 13, wherein said control unit controls said driving unit to drive said intermediate transfer body according to correction information based on a mechanical resonance frequency of the driving systems of said intermediate transfer body corresponding to the kind of image.

15. The image forming apparatus according to claim 14, wherein the correction information is correction information for feed-forward control, and said control unit controls said driving unit to perform feed-forward control of said intermediate transfer body based on the correction information.

16. The image forming apparatus according to claim 13, further comprising:

storage unit for storing plural pieces of correction information in association with kinds of images, wherein said control unit reads the correction information from said storage means according to the kind of image, and controls said driving unit to drive said intermediate transfer body based on the correction information.

17. A method for operating a color image forming apparatus comprising the steps of:

selectively actuating a transfer unit according to a kind of image;

reading correction information related to control of the rotational speed of each image carrier from a storage unit according to the kind of image;

controlling the rotational speed of each image carrier under a feed-forward control and a feed-back control based on the read correction information, wherein the correction information used for the feed-forward control is different depending upon the kind of image; and transferring a toner image of a specific color on the image carrier onto an intermediate transfer body at a controlled rotational speed.

18. The control method for a color image forming apparatus according to claim 17, wherein the correction information related to control of the rotational speed is correction information for feed-forward control of each image carrier performed by the driving mechanism, the correction information including a frequency component based on a mechanical resonance frequency of the driving system of the image carrier.

19. A method for operating a color image forming apparatus comprising the steps of:

selectively actuating a transfer unit according to a kind of image;

reading correction information related to control of the rotational speed of each image carrier from a storage unit according to the kind of image;

controlling the rotational speed of each image carrier based on the read correction information under a feed-forward control and a feed-back control, wherein feed-forward control is carried out for a full-color image and feed-back control is carried out for a mono-chrome image or a uni-color image.

20. The control method for a color image forming apparatus according to claim 19, wherein the rotary speed of each image carrier is the same for any kind of image.

* * * * *